United States Patent [19]

Ortelli

[11] 4,223,595

[45] Sep. 23, 1980

[54] DEVICE FOR COUPLING THE PISTONS TO THE ROTOR IN A RADIAL-PISTON HYDRAULIC MOTOR

[75] Inventor: Aurelio Ortelli, Bologna, Italy

[73] Assignee: Riva Calzoni S.p.A., Milan, Italy

[21] Appl. No.: 906,920

[22] Filed: May 18, 1978

[30] Foreign Application Priority Data

May 26, 1977 [IT] Italy ..... 24032 A/77

[51] Int. Cl.[2] ..... F04B 1/04

[52] U.S. Cl. ..... 92/72; 91/491; 92/148; 417/273

[58] Field of Search ..... 92/12.1, 72, 148; 91/491; 417/273

[56] References Cited

U.S. PATENT DOCUMENTS

| | | | |
|---|---|---|---|
| 3,320,902 | 5/1967 | Paschke | 417/273 X |
| 3,945,766 | 3/1976 | Gelon | 417/273 |
| 3,968,736 | 7/1976 | Pecorari | 92/148 X |

*Primary Examiner*—Gerald A. Michalsky
*Attorney, Agent, or Firm*—Weingarten, Maxham & Schurgin

[57] ABSTRACT

The device is comprised of an auxiliary annular element concentrically mounted on each piston end facing the spherical surface of the rotor. Each piston end is provided with an annular shoulder bearing against a matching annular shoulder formed on the inner periphery of the circular aperture through which the auxiliary annular element is mounted on the piston end. The same auxiliary annular element is also provided with oppositely disposed lateral flanges, in a position corresponding to the sides of the rotor, each having a respective recess which is open in the axial direction opposite to the corresponding side of the rotor and extending in the circumferential direction in an arc of a circle concentric with the rotor. Coupling rings disposed at the sides of the rotor, concentrically therewith, engage said recesses to hold the piston end in contact with the spherical surface of the rotor.

3 Claims, 6 Drawing Figures

DEVICE FOR COUPLING THE PISTONS TO THE ROTOR IN A RADIAL-PISTON HYDRAULIC MOTOR

BACKGROUND OF THE INVENTION

1. Field of the Invention

The present invention relates to an improved device for coupling the pistons to the rotor in a radial-piston hydraulic motor in which the peripheral surface of the rotor has a spherical shape.

2. Prior Art

As is known, hydraulic motors of the aforementioned kind comprise a housing containing a rotor having a spherical surface and eccentrically mounted on the driving shaft and secured thereto, the motors also comprising a number of hydraulic pistons radially disposed around the rotor, one end of each piston being in permanent oscillating contact with corresponding bearing seats formed in the inner walls of corresponding radial cavities associated with the motor housing, whereas the other end is in sliding contact with the spherical surface of the rotor and held in contact therewith by a pair of coupling rings disposed at the sides of the rotor and engaging the aforementioned end of each piston. The hydraulic fluid is distributed to the radial pistons in known, conventional manner, via that end of each piston which is in permanent oscillating contact with the respective cavity associated with the engine housing, corresponding to the respective bearing seats. In a known type of motor, hydraulic pressure fluid is driven through the cavities in the piston directly against the spherical end of the rotor, where it is retained by the outer edges of the corresponding end of the pistons, which slide in contact with the spherical surface of the rotor.

Normally, sliding contact between the ends of the radial pistons and the spherical rotor surface is maintained by a spring means which is inserted between the telescopically-movable components of each radial piston.

In the case of the aforementioned kinds of motors, however, it has been found necessary in practice to provide additional means for ensuring contact between the radial ends of the pistons and the underlying spherical surface of the rotor since temporary negative pressures may sometimes occur inside the pistons and raise their ends from the spherical surface of the rotor against the action of the spring, thus endangering the radial seal of the hydraulic fluid and preventing proper operation of the motor.

To avoid this disadvantage, it has already been proposed to couple the end of each radial piston to a pair of rings concentric with the rotor and placed on each side of it, so as to permanently secure the pistons to the spherical surface of the rotor.

In the prior art, the rings, which are secured at the sides of the rotor, engage corresponding projections formed directly on the end of each radial piston.

In practice, however, the aforementioned coupling devices have a disadvantage in that the stresses transmitted by the end of each radial piston to the corresponding coupling rings are excessively concentrated in regions of limited area, which results in excessive forces being concentrated on the rings and possibly deforming them.

According to another feature of the prior art, the coupling device the ends of the pistons and the spherical rotor surface does not leave the end sufficient freedom relative to the spherical surface, and this results in excessive wear since the end always slides on the same portion of the spherical surface.

SUMMARY OF THE INVENTION

The object of the invention, therefore, is to provide a coupling device for obviating the disadvantages of the prior-art devices.

The invention is based on the problem of distributing the stresses between the ends of the radial pistons and the coupling rings along a sufficiently wide arc of the periphery of the rings and simultaneously to permit limited motion of the piston ends on the spherical rotor surface, by more closely adapting the pistons to the surface and by eliminating local wear.

To this end, according to the invention, that end of each piston which faces the rotor has an annular shoulder bearing against a matching shoulder formed on the inner periphery of a circular aperture formed on an auxiliary annular element concentric with the piston, the annular element also having oppositely-disposed lateral flanges in a position corresponding to the sides of the rotor, each lateral flange having a recess which is open in the axial direction opposite to the corresponding side of the rotor and extending in the circumferential direction in an arc of a circle concentric with the rotor, the recess containing a corresponding circumferential portion of the associated coupling ring.

According to a feature of the invention, the surface of the annular shoulder of the end of each radial piston engaging the matching shoulder of the circular aperture provided in the auxiliary annular element has a substantially spherical shape, its concavity facing the spherical under-surface of the rotor.

The invention will now be described in greater detail with reference to an embodiment illustrated in the accompanying drawings.

DETAILED DESCRIPTION OF THE INVENTION

The accompanying drawings show a rotor 1 of a conventional hydraulic motor comprising radial pistons. The rotor is eccentrically mounted on a driving shaft 2 and has a spherical peripheral surface 3 and flat sides 4, 5 perpendicular to the driving shaft 2.

Figure 1:
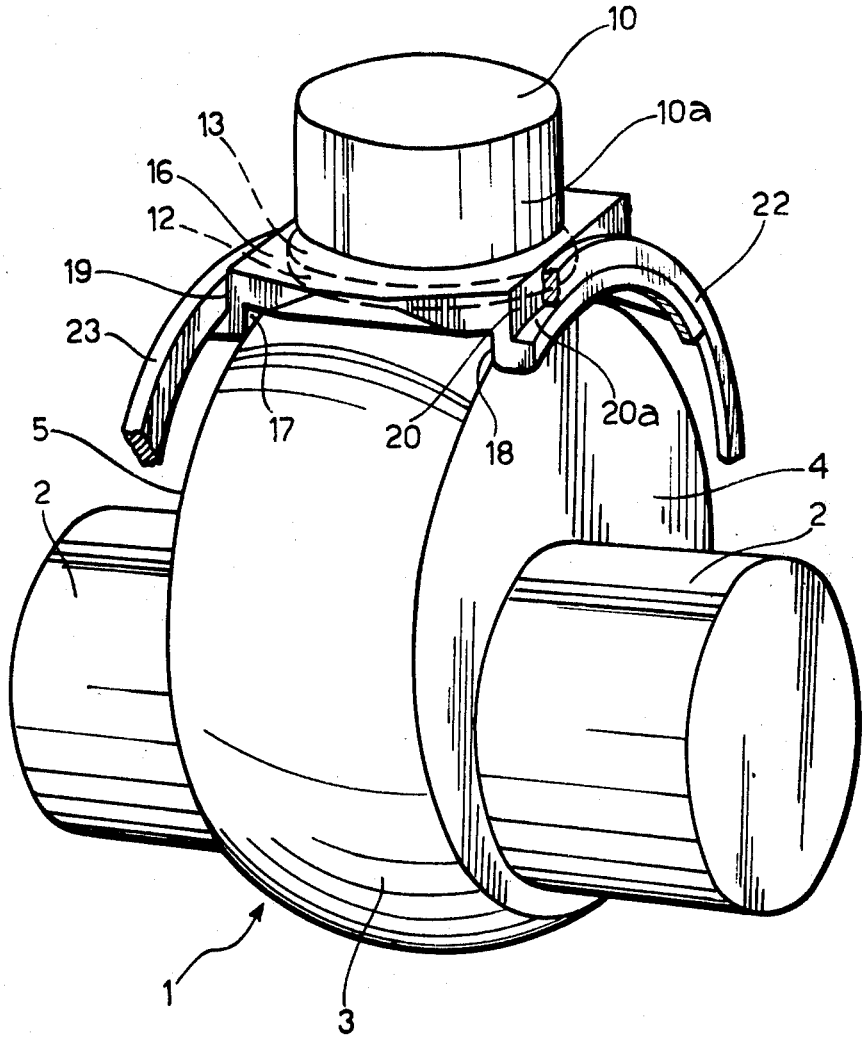
FIG. 1 is a diagrammatic, partial perspective view of the relevant parts of a device according to the invention, with reference to a single piston.
Figure 2:
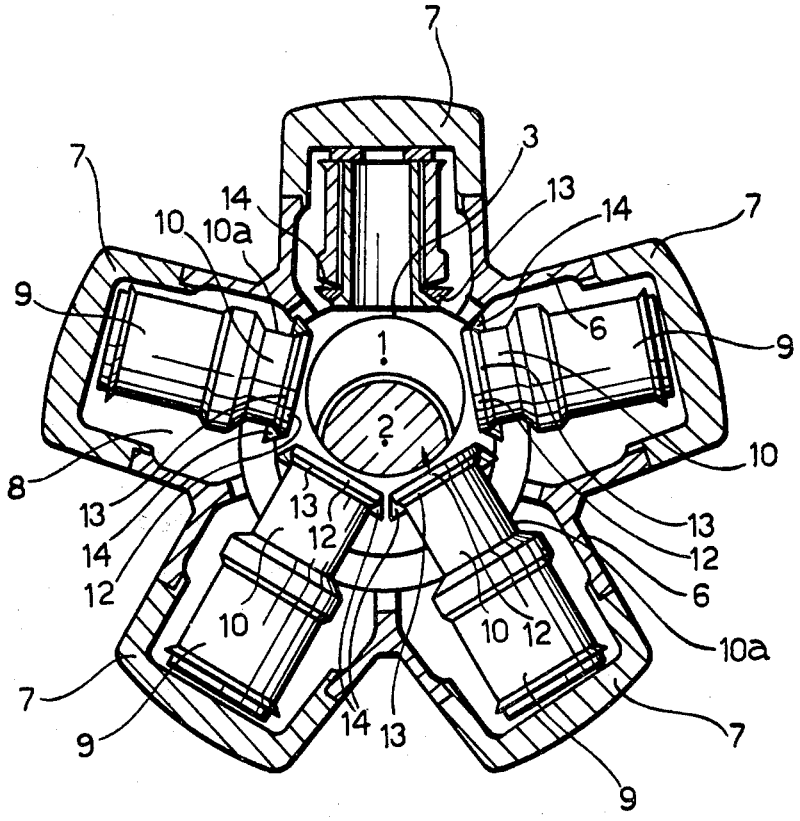
FIG. 2 is a diagrammatic radial section of a hydraulic motor comprising radial pistons incorporating the device according to the invention.
Figure 3:
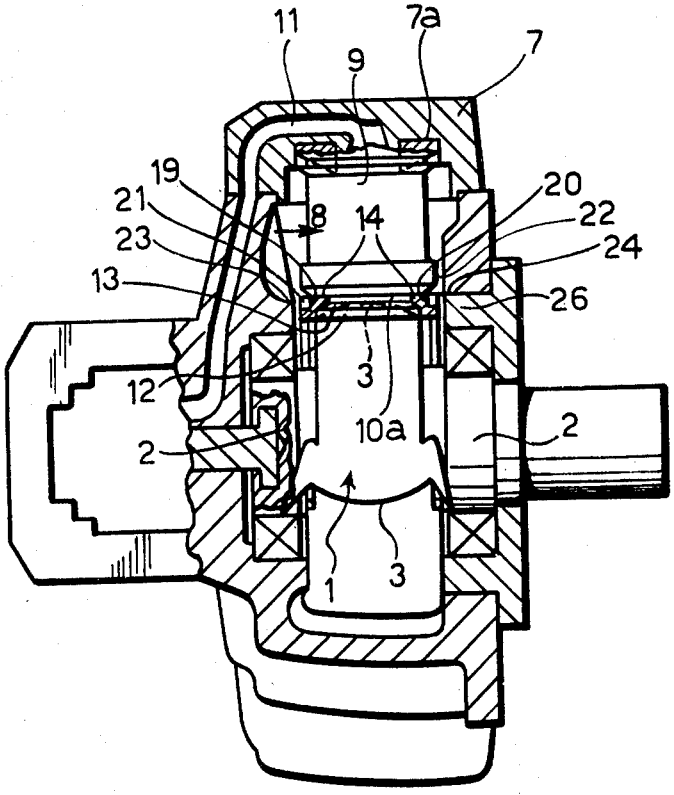
FIG. 3 is a cross-section of a radial-piston hydraulic motor corresponding to a piston provided with the device according to the invention.
Figure 4:
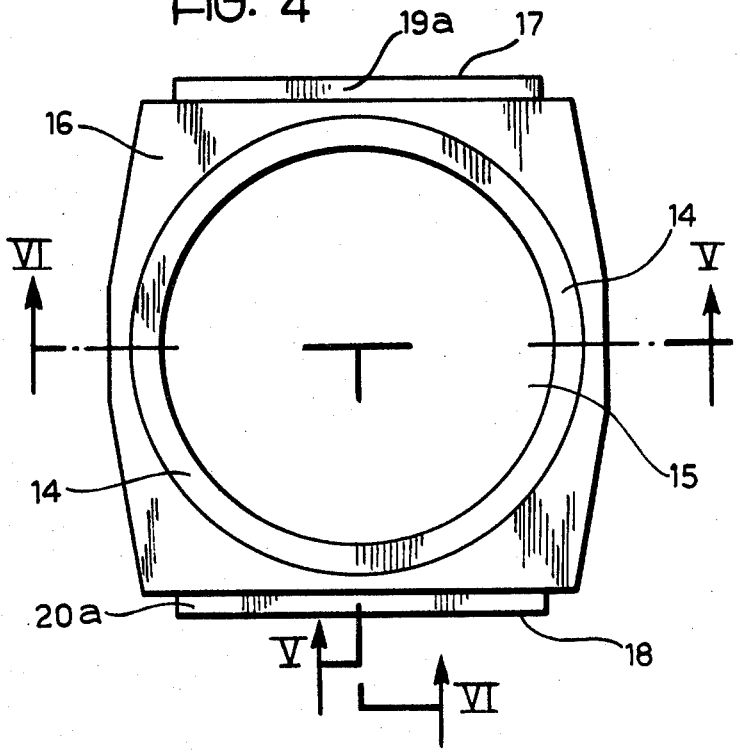
FIG. 4 is a plan view of the auxiliary annular element for coupling the pistons according to the invention.
Figure 5:
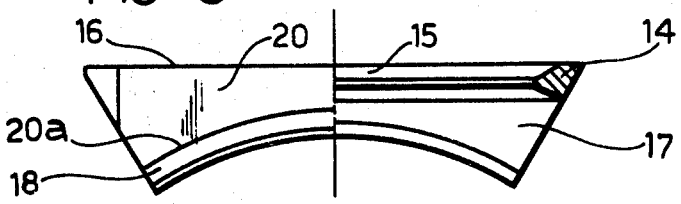
FIG. 5 is a side view of the annular coupling element, partly in section along line V—V in FIG. 4.
Figure 6:
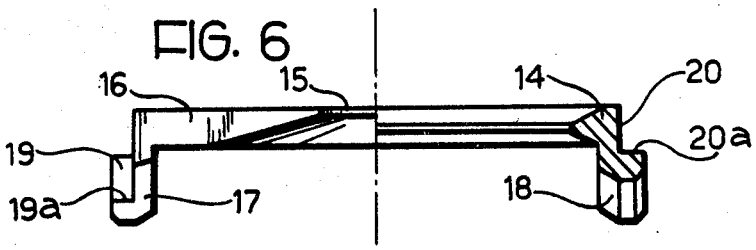
FIG. 6 is a second lateral view of an annular coupling element, partly in section along line VI—VI in FIG. 4.

As shown in FIGS. 2 and 3, rotor 1 and the associated driving shaft 2 are mounted inside a cavity 6 which defines a number of radially-disposed hollow cylindrical seats 7.

In conventional manner, these seats receive a corresponding number of hydraulic pistons 8, each comprising two parts 9, 10 which fit telescopically into one another. In conventional manner likewise, the hydraulic pressure fluid is supplied by a suitable distributor (not shown) to that end of each piston 8 facing the end wall 7*a* of the cylindrical seats 7. The duct supplying pressure fluid is indicated by 11 in FIG. 3.

The end 10*a* of each radial piston facing the spherical surface 3 of rotor 1 has an annular edge 12 defining a shoulder 13 having a substantially spherical surface, its concavity facing the spherical surface of the rotor. The surface can either be exactly spherical or near-spherical and conical. The annular shoulder 13 engages a matching shoulder 14 formed on the inner edge of a circular aperture 15 in an auxiliary annular element 16 mounted coaxially with part 10 of each radial piston.

Element 16 has two oppositely-disposed lateral flanges 17, 18 extending along the flat sides 4, 5 of rotor 1. Each flange 17, 18 has an associated recess 19, 20 respectively which opens in the opposite direction to the flat sides 4, 5 of rotor 1 and, together with sides 19*a* and 20*a*, extends along an arc of a circle concentric with rotor 1.

Coupling rings 21, 22 engage in recesses 19, 20 and are likewise concentric with rotor 1. The rings bear circumferentially on the arcuate sides 19*a*, 20*a* of the recesses, which are on a circle having a diameter substantially equal to the internal diameter of rings 21 and 22.

Rings 21, 22 bear axially on edges 23, 24 of lateral shoulders 25, 26 of holders 27, 28 of shaft 2. As can be seen, during operation of the motor the individual radial pistons 8 are held against the spherical surface 3 of rotor 1 by the action of rings 21, 22 on the corresponding surfaces (arcs of a circle) 19*a*, 20*a* of recesses 19, 20 in the auxiliary elements 16 of each piston 8. The action is transmitted by elements 16 to the end 10*a* of the associated radial piston, which however retains sufficient liberty of motion to adapt to the spherical surface 3 of rotor 1, since the matching shoulder 14 in aperture 15 allows the coupled annular edge 12 of end 10*a* to move both around the longitudinal axis of the piston and in any transverse direction (to a limited extent of course) around the centre of the sphere or nearly-spherical cone which includes the surface of shoulder 13.

The advantages of the device according to the invention are that the radial pistons 8 bear in stable manner on the spherical surface 3 of rotor 1 and the forces resulting from coupling rings 21, 22 during operation of the motor are distributed, in the case of each piston, over a sufficiently wide extent on the arcuate sides 19*a*, 20*a* of recesses 19 and 20. This prevents deformation of rings 21 and 22.

Another advantage is that since the end 10*a* of each radial piston can move slightly on the spherical surface 3 of rotor 1, the wear thereon is distributed over a wider area, thus prolonging the life of the motor.

What is claimed is:

1. In a radial-piston hydraulic motor of the type having a rotor eccentrically mounted to a drive shaft within a motor housing, wherein the rotor has a spherical circumferential surface and oppositely disposed flat annular end surfaces normal to the longitudinal axis of said shaft, the motor having a plurality of pistons radially disposed around the rotor, each piston being enclosed within a radial cavity formed with the motor housing, each cavity having a radially disposed inner wall formed with a bearing seat, each piston having one end in permanent oscillating contact with said bearing seat and the other end in sliding contact with the spherical surface of said rotor, a device for coupling each of said pistons to said rotor, said device comprising:

an annular shoulder formed on said other end of said piston;

an auxiliary annular element formed with a circular aperture, said aperture being enclosed by a shoulder formed to mate with said shoulder on said piston, said auxiliary element being loosely concentrically mounted on said piston with said piston extending through said aperture;

a pair of oppositely disposed lateral flanges on said auxiliary element, said flanges being arranged adjacent and generally parallel with said end surfaces of said rotor, each said lateral flange being formed with a recess defined by a cylindrical arc surface concentric with said rotor and a surface adjacent to said cylindrical arc surface parallel with the adjacent rotor end surface whereby said recess is open in a direction parallel with the axis of said shaft; and a pair of coupling rings disposed in said recesses of all of said auxiliary elements thereby holding said pistons against the spherical surface of said rotor.

2. The device recited in claim 1 wherein said annular shoulder on said piston has a substantially spherical shape, the concavity thereof facing said spherical surface of said rotor.

3. The device recited in claim 1 wherein said cylindrical arcs of said recesses form portions of the circumference of a circle having a diameter substantially equal to the internal diameter of said coupling rings.

* * * * *